US005696336A

United States Patent [19]

Sperzel

[11] Patent Number: 5,696,336

[45] **Date of Patent: *Dec. 9, 1997**

[54] STRING SUPPORT

[76] Inventor: Robert J. Sperzel, Marine Tower-East, Unit 1503, 12520 Edgewater Dr., Lakewood, Ohio 44107

[ * ] Notice: The term of this patent shall not extend beyond the expiration date of Pat. No. 5,492,044.

[21] Appl. No.: 371,004

[22] Filed: Jan. 10, 1995

Related U.S. Application Data

[63] Continuation-in-part of Ser. No. 106,360, Aug. 13, 1993, Pat. No. 5,492,044, and Ser. No. 344,529, Nov. 23, 1994, Pat. No. 5,438,901, and Ser. No. 68,122, May 25, 1993, Pat. No. 5,394,783, which is a continuation-in-part of Ser. No. 963,074, Oct. 19, 1992, abandoned.

[51] Int. Cl.[6] ..... G10D 3/06

[52] U.S. Cl. ..... 84/314 N; 84/297 R

[58] Field of Search ..... 84/314 N, 297 R, 84/298, 307

[56] References Cited

U.S. PATENT DOCUMENTS 4,304,163 12/1981 Siminoff ..... 84/314 N 5,173,565 12/1992 Gunn ..... 84/298

5,260,504 11/1993 Turner .

5,492,044 2/1996 Sperzel ..... 84/314 N

*Primary Examiner*—Cassandra C. Spyrou

*Attorney, Agent, or Firm*—Tarolli, Sundheim, Covell, Tummino & Szabo

[57] ABSTRACT

A string support assembly for a musical instrument includes a base member and a pair of string support members which cooperate to support a string. The string support members have cylindrical shank sections which are received in openings in a base member. Head sections are connected to the shank sections. The head sections have arcuate side surfaces which engage the string. In one embodiment of the invention, the arcuate side surfaces on the head sections are conical. In another embodiment of the invention, the arcuate side surfaces on the head sections are hemispherical. The base member may be machined from a block of metal or formed from sheet metal.

57 Claims, 5 Drawing Sheets

4
44
86
80
60
72
130
70
122
40
64
58
38
56
36
54
34
52
32
50
30
12
46

14
16
10
114
64
12

9
36
124
44
70
56
38
102
130
72
58
74
80
60
132
108
40
110
96
104
106

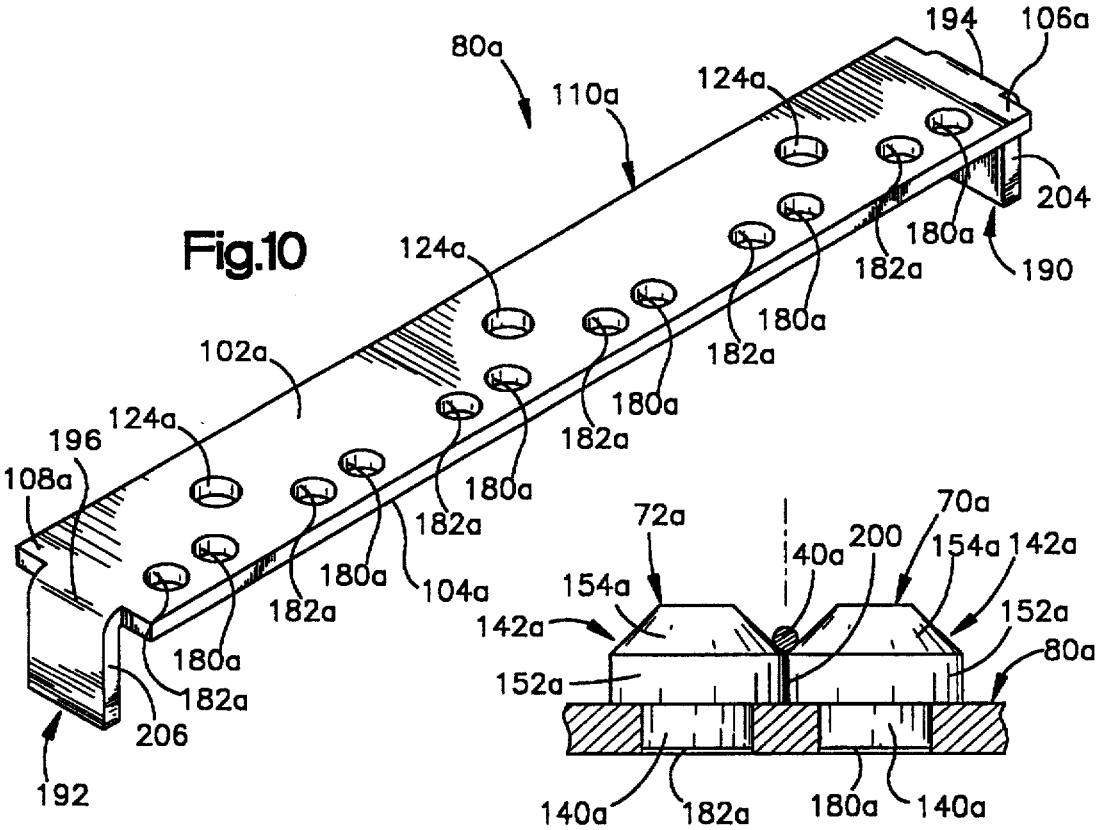
Fig.10
Fig.11
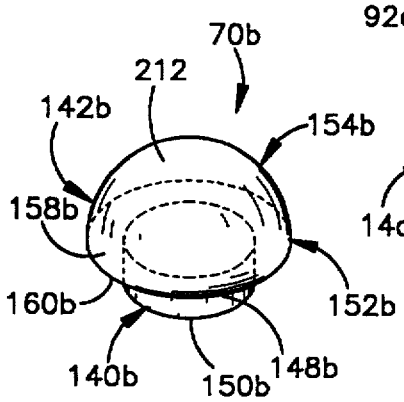
Fig.13
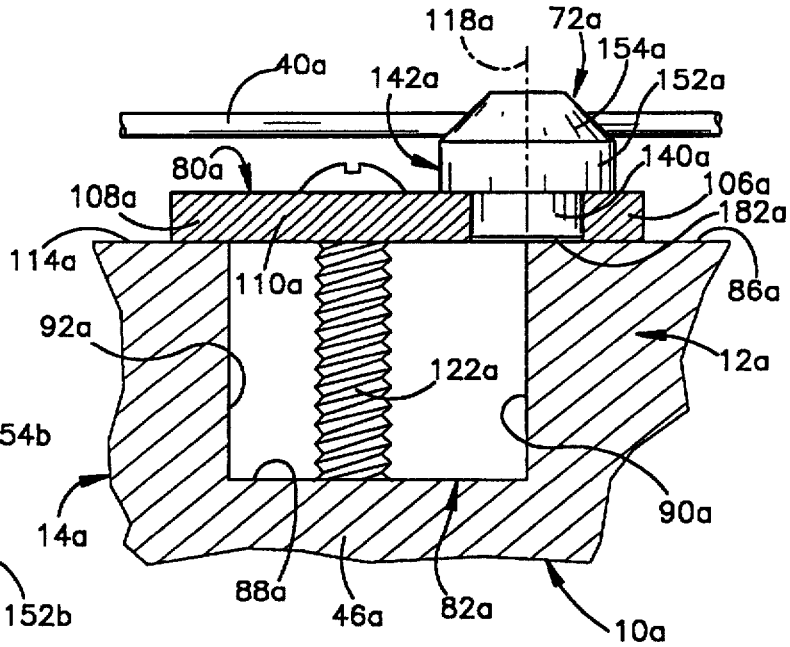
Fig.12

STRING SUPPORT

This application is continuation in part of application Ser. No. 08/106,360 filed Aug. 13, 1993 now U.S. Pat. No. 5,492,044 and application Ser. No. 08/344,529 filed Nov. 23, 1994 now U.S. Pat. No. 5,438,901. Application Ser. No. 08/106,360 filed Aug. 13, 1993 now U.S. Pat. No. 5,492,044 is a continuation in part of Ser. No. 08/068,122 filed May 25, 1993 now U.S. Pat. No. 5,394,783 which is a continuation in part of application Ser. No. 07/963,074 filed Oct. 19, 1992 now abandon. Application Ser. No. 08/344,529 filed Nov. 23, 1994 now U.S. Pat. No. 5,438,901 is a continuation of 08/963,074 filed Oct. 19, 1992 now abandon.

BACKGROUND OF THE INVENTION

The present invention relates to a new and improved string support assembly for use with a guitar or similar stringed instrument to position strings relative to the instrument.

Stringed musical instruments of the guitar type commonly have a body portion, a neck portion which extends outwardly from the body portion, and a head portion connected with an end of the neck portion opposite from the body portion. A plurality of tuning devices are mounted on the head portion and are operable to adjust the tension in strings which extend from the head portion along the neck portion to the body portion of the instrument. A nut or string support system is provided adjacent to a connection between the head and neck portions of the instrument. The nut positions the strings relative to the neck portion of the instrument.

The manner in which the nut cooperates with the strings is very important in obtaining the desired tone from the instrument. Thus, the nut must be accurately located to determine the effective length of the strings. The nut must hold the strings against sidewise movement in order to avoid a buzzing sound effect. During the operation of a tremolo, the nut should allow the tension in the strings to be varied in a predictable manner. The nut should be constructed in such a manner as to enable a uniform spacing to be obtained between each of the strings and the frets on the neck of the guitar.

In the past, the nut has included a straight piece of material in which slots are formed. Substantial care and effort is required to form the slots in the nut with a width which corresponds exactly to the diameter of the strings to prevent sidewise movement of the strings. In addition, the orientation of the slots must be carefully and accurately determined to have the strings go straight back from a front edge of the nut to the tuning devices on the head portion of the guitar. In addition, substantial effort must be expended to form the slots with a depth which will result in each of the strings being spaced the same distance from an arcuate upper side surface on each of the frets on the neck of the guitar. Unfortunately, after the guitar is used over a period of time, the nut wears and must be replaced.

SUMMARY OF THE INVENTION

An improved string support is used in a musical instrument of the guitar type. This type of musical instrument commonly has a plurality of strings which extend from tuning devices on a head portion, along a neck portion, to a body portion of the instrument. The improved string support positions the strings relative to the head and neck portions of the instrument.

The string support may include a base member which extends beneath the strings. A plurality of pairs of string support members may be disposed on the base member. Each of the string support members has a shank section which is disposed in an opening in the base member. Each of the string support members includes head section having an arcuate surface which engages a string of the musical instrument. In one specific embodiment of the invention, the head section of each of the string supports includes a conical section on which the arcuate surface, which engages the string, is disposed. In another embodiment of the invention, the head section of each of the string supports includes a hemispherical section.

BRIEF DESCRIPTION OF THE DRAWINGS

The foregoing and other features of the present invention will become more apparent upon a consideration of the following description taken in connection with the accompanying drawings, wherein:

FIG. 10 is a pictorial illustration of a second embodiment of the base member;

FIG. 11 is an enlarged fragmentary view illustrating the manner in which a pair of string support members are mounted on the base member of FIG. 10 and engage a string;

FIG. 12 is a fragmentary sectional view, generally similar to FIG. 7, illustrating the relationship of the base member of FIG. 10 and one of the string support members of FIG. 11 to a groove formed at a connection between the head and neck portions of the musical instrument; and FIG. 13 is a pictorial illustration of another embodiment of the string support member.

DESCRIPTION OF SPECIFIC PREFERRED EMBODIMENTS OF THE INVENTION

General Description

Figures 1, 2, 3:
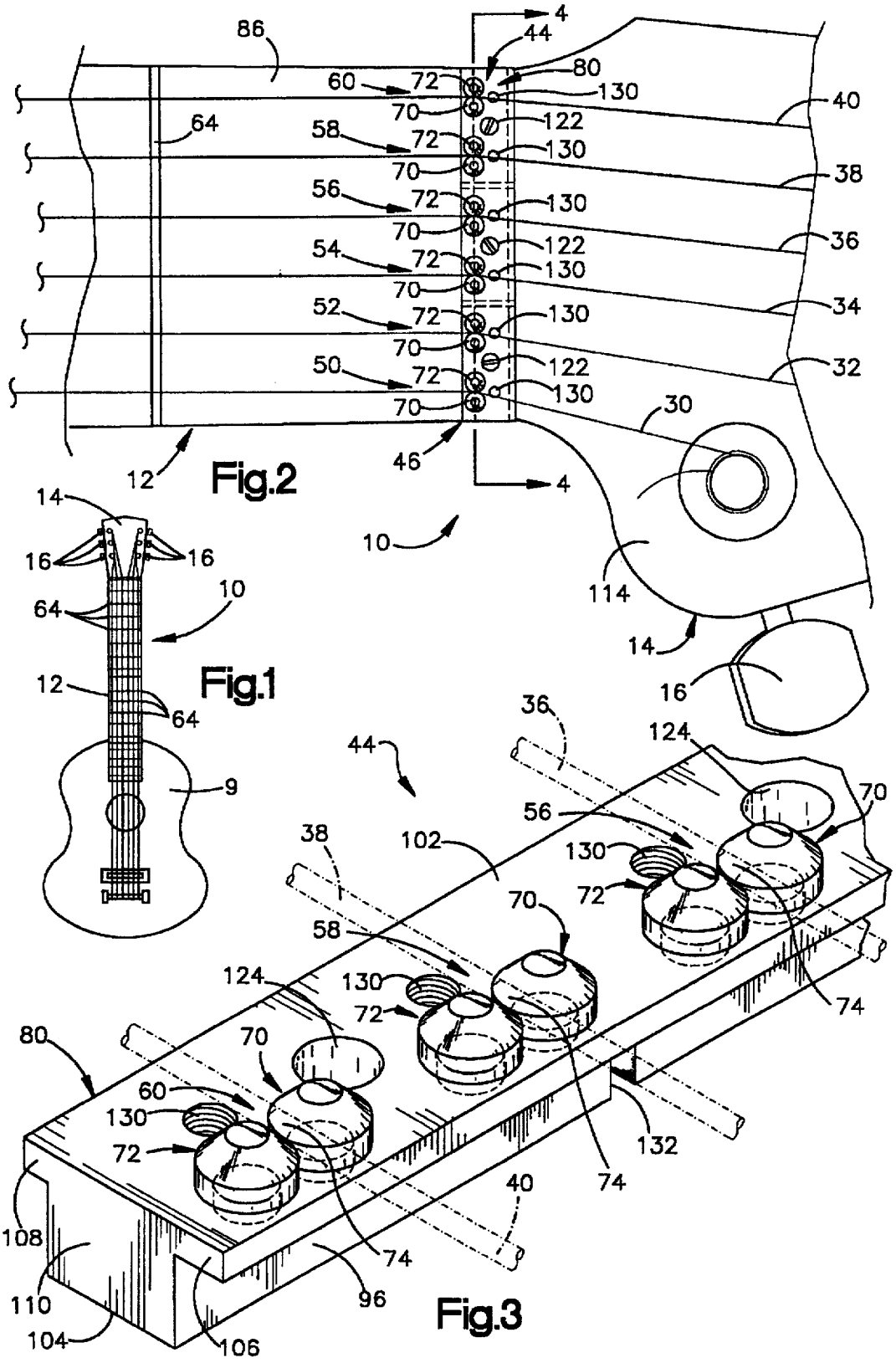
FIG. 1 is a simplified illustration of a stringed musical instrument of the guitar type.
FIG. 2 is a fragmentary and somewhat schematicized plan view illustrating the relationship between a neck portion, head portion and a plurality of strings in the musical instrument of FIG. 1.
FIG. 3 is an enlarged pictorial illustration of a portion of a string support assembly constructed in accordance with the present invention.

A musical instrument 10 is shown in FIG. 1. The musical instrument 10 is a guitar and includes a body portion 9 having a sounding board. A neck portion 12 extends outward from the body portion 9 of the musical instrument 10. A head portion 14 is connected with the neck portion 12. The head and neck portions 12 and 14 are formed of wood. However, the head and/or neck portions 12 and 14 could be formed of a different material if desired.

A plurality of tuning devices, one of which is indicated at 16 in FIG. 2, are provided on the head portion 14. The tuning devices are operable to adjust the tension in strings 30, 32, 34, 36, 38 and 40 in a known manner. The tuning devices are advantageously constructed in the manner disclosed in U.S. Pat. No. 4,625,614

The strings 30–40 extend from the tuning devices on the head portion 14 along the neck portion 12 of the guitar to the body portion 9 of the guitar. A tremolo may be provided on the body portion 9 to vary the tension in the strings 30–40 in a known manner. The general construction of the musical instrument 10 is well known and may be in accordance with the construction of any one of many different commercially available guitars.

An improved string support assembly 44 (FIG. 2), constructed in accordance with the present invention, is provided adjacent to a connection 46 between the neck and head portions 12 and 14 of the musical instrument 10. The string support assembly 44 positions the strings 30–40 relative to the neck portion 12 of the musical instrument 10. The string support assembly 44 performs functions performed by a nut in known guitars.

The improved string support assembly 44 includes a plurality of string supports 50, 52, 54, 56, 58 and 60 (FIGS. 2 and 4) which are disposed in a linear array. There is a string support 50–60 for each of the strings 30–40. The string supports 50–60 engage the strings to locate them relative to each other and to frets 64 on the neck portion 12 of the guitar 10.

In accordance with one of the features of the present invention, each of the string supports 50–60 includes a pair of string support members 70 and 72 (FIGS. 2–6). The string support members 70 and 72 in each string support 50–60 cooperate to support one of the strings 30–40. The string support members 70 and 72 enable each of the strings 30–40 to be supported at a predetermined location along the neck 12 of the musical instrument 10 to provide an accurately located intonation point for the string. The string support members 70 and 72 also accurately locate the strings 30–40 relative to the frets 64 (FIG. 2) on the neck portion 12 of the musical instrument 10.

In addition to accurately locating the strings 30–40, the string support members 70 and 72 cooperate with the strings to hold them against sideways movement at the string support assembly 44. This minimizes objectionable noise or buzzing. The string support members 70 and 72 enable the strings 30–40 to extend in either a continuous straight line along the neck portion 12 and head portion 14 or to bend at the string support assembly 44. This enables the string supports 50–60 to be used with guitars having tuning devices at almost any desired location on the head portion of the guitar.

The string support members 70 and 72 in the string supports 50–60 enable the strings 30–40 to have different diameters. Thus, the diameters of the strings 30–40 progressively increase from a relatively small diameter string 30 to a relatively large diameter string 40. The reason that the identical string supports 50–60 may be used with the strings of different diameters is that outer side surfaces of the string support members 70 and 72 cooperate to form a recess or nip 74 (FIG. 3) which tapers downwardly (as viewed in FIGS. 3 and 4). The tapering nip 74 allows the string support members 70 and 72 to engage opposite sides of strings 30–40 having different diameters and to hold the different diameter strings against sideways movement. If desired, the string supports 50–60 may have dimensions corresponding to the diameter of the strings with which the string supports are used.

In the embodiment of the invention illustrated in FIGS. 1–9, the string support members 70 and 72 are mounted on a one piece metal base member 80 (FIG. 3). However, the base member 80 may be eliminated if desired. If this is done, the string support members 70 and 72 would be mounted directly in the material forming the connection 46 between the neck and head portions 12 and 14.

The manner in which the string support members 70 and 72 cooperate with the strings 30–50 is the same as is described in the aforementioned U.S. patent application Ser. No. 07/963,074 filed Oct. 19, 1992 by Robert J. Sperzel and entitled "String Support for Musical Instrument" and in the aforementioned U.S. patent application Ser. No. 08/106,360 filed Aug. 13, 1993 by Robert J. Sperzel and entitled "String Support".

String Support Assembly—Base Member

The string support assembly 44 includes the one-piece metal base member 80 (FIGS. 2, 3 and 4) which is machined from a single block of metal. The base member 80 has a generally rectangular configuration. The base member 80 is disposed in a rectangular groove 82 (FIGS. 4 and 7) which extends across the connection 46 between the head and neck portions 12 and 14 of the musical instrument 10 (FIG. 2). The groove 82 has a longitudinal central axis which extends perpendicular to a longitudinal central axis of the neck portion 12 of the musical instrument 10.

The neck portion 12 of the musical instrument has an arcuate upper side surface 86 (FIGS. 2, 4 and 7) which is formed as a portion of a cylinder having a relatively large diameter. Thus, the upper side surface 86 of the neck portion 12 could have a radius of curvature of ten inches or more.

Figure 7:
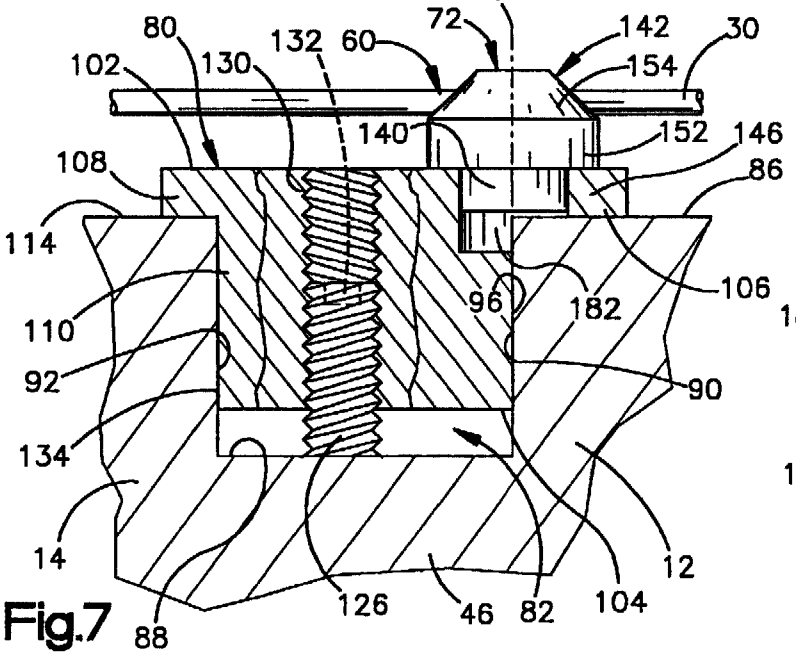
FIG. 7 an enlarged fragmentary sectional view, taken generally along the line 7—7 of FIG. 4, illustrating the relationship of the base member and one of the string support members to a groove formed at a connection between the head and neck portions of the musical instrument of FIG. 1.

Due to the curving configuration of the upper side surface 86 of the neck portion 12, the groove 82 is relatively deep at a central portion of the groove and relatively shallow adjacent to opposite ends of the groove. The groove 82 (FIGS. 4 and 7) has a flat upwardly facing bottom surface 88 which extends beneath the strings 30–40. In addition, the groove 82 has a flat front side surface 90 (FIG. 7). A flat rear side surface 92 of the groove 82 extends parallel to the front side surface 90 and perpendicular to the bottom surface 88. The groove 82 has a longitudinal central axis which extends parallel to the frets 64 and perpendicular to a longitudinal central axis of the neck portion 12.

The flat front side surface 90 (FIG. 7) of the groove 82 engages a flat front side surface 96 on the base member 80 to position the base member and string support members 70 and 72 relative to the neck and head portions 12 and 14 of the musical instrument 10. Thus, abutting engagement of the flat front side surface 96 on the base member 80 with the flat front side surface 90 on the groove 82 accurately locates the base member 80. The groove 82 is cut in the wooden material of the musical instrument 10 at the connection 46 between the neck portion 12 and head portion 14 during formation of slots in the neck portion for the frets 64. Therefore, the groove 82 can be very accurately located at the connection between the neck portion 12 and head portion 14 of the musical instrument.

Figure 4:
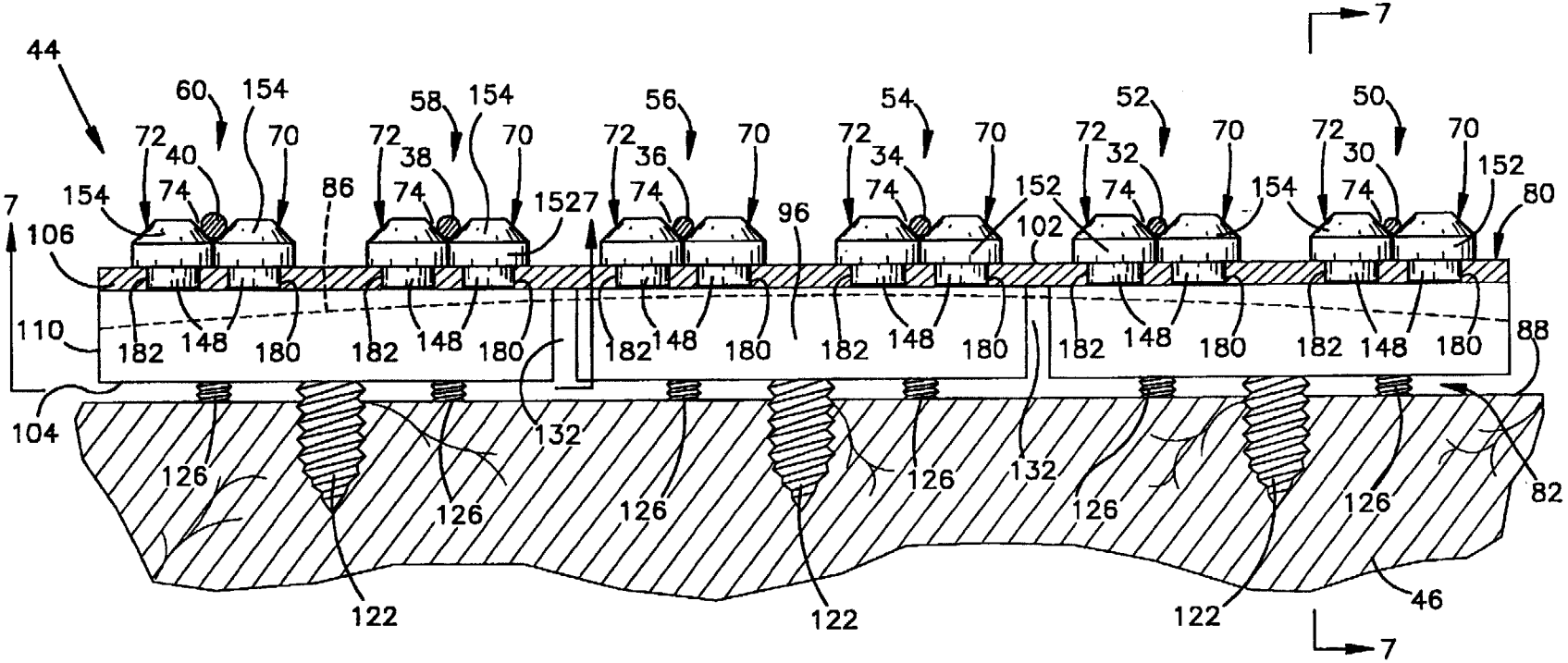
FIG. 4 is a sectional view, taken generally along the line 4—4 of FIG. 2, illustrating the relationship between a base member and a plurality of string support members, the base member being shown in an initial or undeflected condition FIG. 4.
Figure 8:
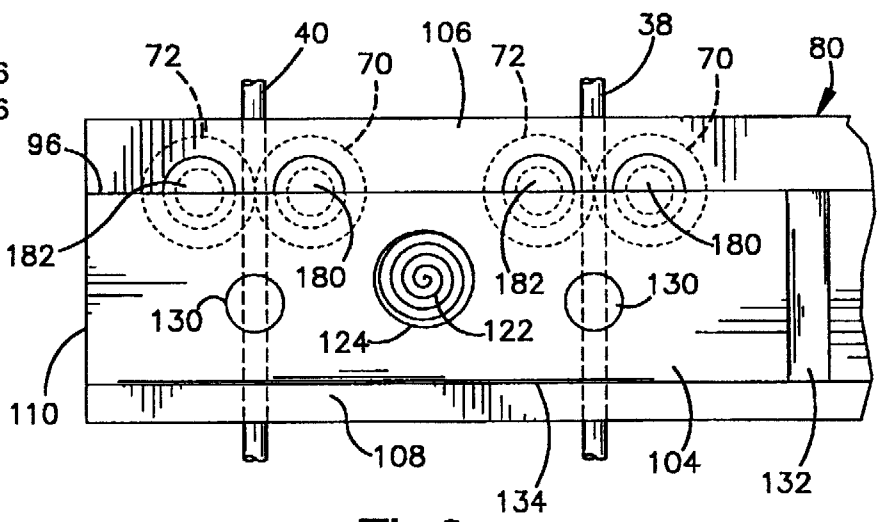
FIG. 8 is a bottom plan view, taken generally along the line 8—8 of FIG. 4, further illustrating the construction of the base member.
Figure 5:
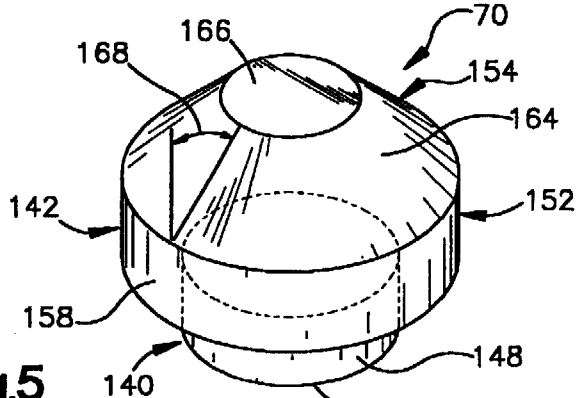
FIG. 5 is an enlarged pictorial illustration of one of the string support members of FIG. 4.

The base member 80 is machined from a single piece of metal (brass) and has a generally rectangular configuration. Thus, the base member 80 has a rectangular upper side surface 102. As originally formed, the upper side surface 102 of the base member 80 is flat (FIG. 4). The base member 80 also has a lower side surface 104 (FIGS. 4, 7 and 8). The rectangular lower side surface 104 of the base extends parallel to the upper side surface 102 of the base member. The base member 80 has front and rear flanges 106 and 108 (FIGS. 3 and 7) which extend from a main body section 110 (FIG. 3) of the base member 80. The front flange 106 extends over the upper side surface 86 of the neck portion 12 of the instrument 10 (FIG. 7). Similarly, the rear flange 108 extends over an upper side surface 114 on the head portion 14 of the instrument 10.

Parallel longitudinal central axes 116 (FIG. 6) of the string support members 70 and 72 are disposed in a flat plane 118 which contains the flat front side surface 90 of the groove 82 (FIG. 7). Since the flat front side surface 90 of the groove 82 is accurately located on the instrument 10, the central axes 116 of the string support members 70 and 72 are accurately located on the instrument.

In the illustrated embodiment of the invention, the parallel central axes 116 of the string support members 70 and 72 are disposed in the plane of the flat front side surface 90 of the groove 82. This construction is preferred because the location where the strings 30–40 engage the nips 74 between the string support members 70 and 72 is in the plane 118 of the flat front side surface 90 of the groove 82. This facilitates retrofitting the string support assembly 44 on instruments in which the groove 82 has previously been formed with the flat front side surface 90 of the groove accurately located relative to other portions of the instrument.

However, if desired, the central axes 116 of the string support members 70 and 72 could be offset either forwardly or rearwardly by a predetermined distance from the flat front side surface 90 of the groove 82. If this was done, the central axes of all of the string support members 70 and 72 would be disposed in a single flat plane which would extend parallel to the flat front side surface 90 of the groove 82. This plane would be offset either forwardly or rearwardly of the flat front side surface 90 of the groove 82.

In the illustrated embodiment of the invention, the base member 80 is attached to the instrument 10 by a plurality of screws 122 (FIGS. 2 and 4). The screws 122 extend through cylindrical openings 124 (FIG. 3) which extend through the base member 80. The screws 122 engage the wooden material of the instrument 10 at the junction 46 between the head portion 14 and neck portion 12 of the instrument.

The base member 80 can be moved either upward or downward (as viewed in FIG. 4) to raise or lower the string support members 70 and 72 and the strings 30–40. Thus, if the distance from the strings 30–40 to the frets 64 is to be increased, the base member 80 is moved upward (as viewed in FIG. 4) relative to the neck and head portions 12 and 14 of the instrument 10. If the distance between the strings 30–40 and the frets 64 is to be decreased, the base member 80 is moved downward. By enabling the position of the base member 80 to be adjusted, the positions of the strings 30–40 can be adjusted to suit the desires of different musicians.

To provide for adjustment of the base member 80 and the positions of the string support members 70 and 72, a plurality of externally threaded positioning elements 126 (FIG. 4) extend from the lower portion of the base member 80. The positioning elements 126 are received in internally threaded openings 130 (FIGS. 7 and 8) which extend through the base member 80. The external threads on the positioning elements 126 engage the internal threads on the openings 130.

Sockets 132 (FIG. 7) are formed in the upper ends of the positioning elements 126. The sockets 132 are accessible from the upper side of the base member 80. Thus, a small tool, such as an allen wrench, can be inserted into the socket 132 to rotate the positioning element 126 relative to the base member 80.

Rotating the positioning element 126 relative to the base member 80 results in the positioning element being moved axially either into or out of the opening 130. The greater the extent to which the positioning elements 126 extend from the openings 130, the greater is the distance between the lower side surface 104 of the base member 80 and the bottom surface 88 of the groove 82 (FIGS. 4 and 7). Similarly, the smaller the distance which the positioning elements 126 extend outwardly from the openings 130, the smaller the distance between the lower surface 104 of the base member 80 and the bottom surface 88 of the groove 82.

The longitudinal central axes of the openings 130 in which the positioning members 132 are located extend parallel to the flat front side surface 96 of the base member 80. Therefore, when the positioning elements 126 are extended or retracted, the flat front side surface 96 of the base member 80 slides along the flat front side surface 90 of the groove 82. This results in the central axes of curvature of the string support members 70 and 72 remaining in the plane 118 as the positioning elements 126 are either extended or retracted. Since the positioning elements 126 are accessible from the upper side of the base member 80, the locations of the positioning elements 126 relative to the base member 80 can be adjusted when the base is disposed in the groove 82.

Deflection of Base Member

The base member 80 (FIG. 4) can be deflected to have a configuration which corresponds to the configuration of the arcuate upper side surface 86 on the neck portion 12 of the instrument 10. As was previously described, the upper side surface 86 on the neck portion 12 of the instrument 10 is a portion of an outer side surface of a cylinder. The cylinder has a central axis which extends parallel to a central axis of the neck portion 12 and perpendicular to a longitudinal central axis of the groove 82. The frets 64 (FIG. 2) have upper side surfaces with the same curvature as the upper side surface 86 of the neck portion 12. The upper side surfaces of the frets 64 are all disposed the same distance above the upper side surface 86 of the neck portion 12. At the connection 46 between the neck and head portions 12 and 14 of the musical instrument 10, the upper side surface 114 of the head portion of the instrument has the same curvature as the upper side surface 86 of the neck portion.

In order to have the distance from each of the strings 30–40 to the upper side surface of a fret 64 be the same, it is necessary to have the string support members 70 and 72 located along an arcuate line having the same curvature as the upper side surface 86 of the neck portion 12 of the instrument. As originally formed, the base member 80 has the linear configuration shown in FIG. 4. When the base member 80 has its initial linear configuration, the string support 50 and the string support 60 at opposite ends of the base support the strings 30 and 40 a relatively large distance above the frets 64. However, the string supports 54 and 56 at the central portion of the base member 80 support the strings 34 and 36 relatively close to the frets 64.

It is believed that most musicians will want to have the strings 30–40 located the same distance from the frets 64. To accomplish this, the base member 80 is resiliently deflected from the linear configuration of FIG. 4 to the arcuate configuration of FIG. 9. When the base member 80 has been deflected to the arcuate configuration of FIG. 9, the upper side surface 102 of the base member will have a configuration which is the same as the configuration of the upper side surface 86 on the neck portion 12 of the instrument 10 and the same configuration as the upper side surface of the frets 64. The centers of the string support members 70 and 72 are all disposed in the plane 118 at the same distance from the upper side surface 102 of the base member 80. Therefore, all the strings 30–40 will be supported substantially the same distance from the upper side surface 86 of the neck portion 12 and the upper side surfaces of the frets 64.

Figure 9:
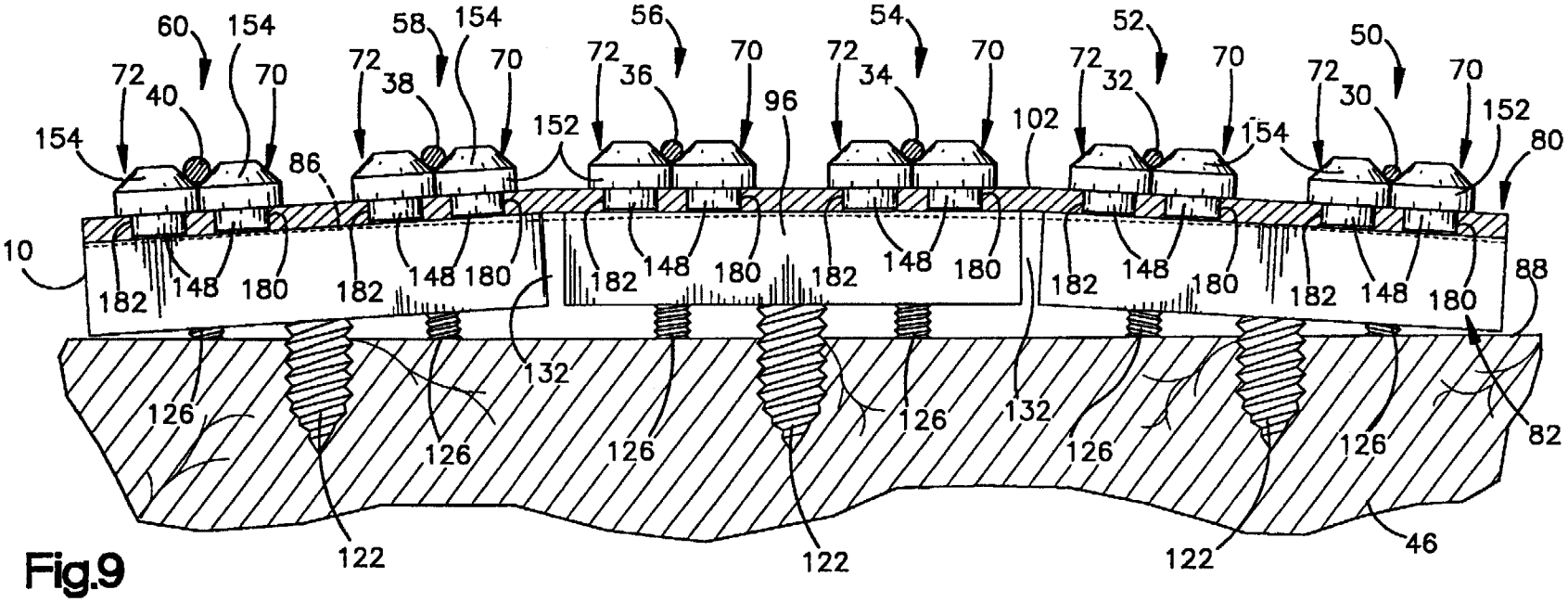
FIG. 9 is a fragmentary sectional view, generally similar to FIG. 4, illustrating the base member in a deflected condition in which the curvature of the base member corresponds to the curvature of an upper side surface of the neck portion of the musical instrument.

To deflect the base member 80 from the linear configuration of FIG. 4 to the arcuate configuration of FIG. 9, the extents to which the positioning elements 126 project from the base member 80 are adjusted to correspond to the desired arcuate configuration of the base member. Thus, the positioning elements 126 associated with the string supports 50 and 60 at opposite ends of the base member 80, are almost fully retracted. The positioning elements 126 associated with the string supports 54 and 56 at the central portion of the base member 80 are extended. The positioning elements 126 associated with the string supports 52 and 58 are extended to a lesser degree than the positioning elements associated with the string supports 54 and 56.

Once the extent to which the positioning elements 126 project from the base member 80 has been adjusted, the screws 122 are tightened to press stop surfaces on the ends of the positioning elements 126 against the bottom surface 88 of the groove 82. As this occurs, the base member 80 is resiliently deflected from the linear configuration of FIG. 4 to the arcuate configuration of FIG. 9. As the base member 80 is deflected, the front side surface 96 of the base remains in flat abutting engagement with the front side surface 90 of the groove 82. Thus, as the base member 80 is deflected, the front side surface 96 of the base slides along the front side surface 90 of the groove 82. As the base member 80 is deflected, at least some of the string support members 70 and 72 move relative to the neck portion 12.

Through a visual inspection, it is relatively easy to determine whether or not the front flange 106 (FIG. 7) of the base member 80 is pressed into abutting engagement with the upper side surface 86 of the neck portion 12 throughout the length of the front flange. If there is a slight gap between the lower side surface of the front flange 106 and the upper side surface 86 of the neck portion 12, a suitable tool, such as an allen wrench, is used to rotate the positioning elements 126 which extend too far from the base member 80. Since the cylindrical openings 130 extend through the base member 80 to the upper side surface 102 of the base (FIG. 7), the positioning elements 126 are accessible and can be adjusted with the base member 80 in the groove 82. Once the positioning elements 126 have been properly adjusted, the screws 122 are again tightened to deflect the base member 80 so that the front flange 106 is in abutting engagement with the upper side surface 86 of the neck portion 12 throughout the length of the front flange.

To facilitate deflection of the base member 80, a plurality of rectangular slots 132 (FIGS. 4 and 8) are formed in the base member. The slots 132 extend between the front side surface 96 and a rear side surface 134 (FIG. 8) of the base member 80. The longitudinal central axes of the slots 132 extend perpendicular to the front and rear side surfaces 96 and 134 of the base member 80. In the illustrated embodiment of the invention, the slots 132 extend upwardly from the lower side surface 104 of the base member 80 to a location which is spaced from the upper side surface 102 of the base member by an amount equal to the thickness of the front and rear flanges 106 and 108.

When the base member 80 is deflected from the initial linear configuration shown in FIG. 4 to the arcuate configuration shown in FIG. 9, the relatively thin portion of the base member extending across the upper ends of the slots 132 is elastically deformed. However, the relatively thin portion of the base member 80 above the slots 132 has sufficient resistance to deflection so that the upper side surface 102 of the base has a continuous arcuately curving configuration. The continuous arcuately curving configuration of the upper side surface of the base member 80 and the flange 106 corresponds to the continuous arcuately curving configuration of the upper side surface 86 on the neck portion 12. When the base member 80 is deflected to the curved configuration shown in FIG. 9, the central axes of curvature of the string support members 70 and 72 are still in the plane 118 (FIG. 7).

String Support Members

The string support members 70 (FIGS. 5 and 6) each have a shank section 140 and a head section 142. The head section 142 projects outward of the shank section 140 in a direction transverse to the longitudinal central axis 116 (FIG. 6) of the string support member 70. The shank section 140 and head section 142 of the string support member 70 are integrally formed from one piece of metal. In one specific embodiment of the string support member 70, the string support member was formed of 420 grade stainless steel hardened to about 58–60 Rockwell C hardness. However, it is contemplated that the string support member 70 could be formed of a different material if desired.

Figure 6:
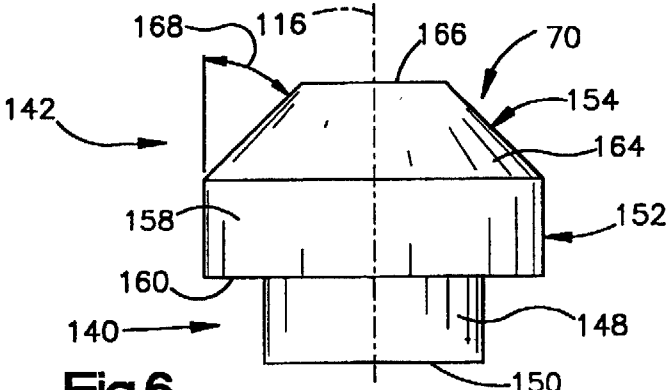
FIG. 6 is a side elevational view of the string support member of FIG. 5.

The shank section 140 (FIGS. 5 and 6) of the string support member 70 has a cylindrical configuration. Thus, the shank section 140 has a cylindrical outer side surface 148 having a central axis which is coincident with the central axis 116 of the string support member 70. The shank section 140 has a flat circular bottom surface 150 (FIG. 6). The bottom surface 150 extends perpendicular to the central axis 116 of the string support member 70. The shank sections 40 of the string support members 70 in the string supports 50–60 are all the same size.

Although the shank section 140 of a string support member 70 could have many different sizes, in one specific embodiment of the string support member 70, the shank section 140 had a diameter of approximately 0.063 inches. In this specific embodiment of the string support member 70, the shank section 140 had an axial extent or height of approximately 0.030 inches. It should be understood that it is contemplated that the shank section 140 of the string support member 70 may be formed with many different dimensions and that the foregoing specific dimensions for one embodiment of the string support member have been set forth herein for purposes of clarity of description and not for purposes of limitation of the invention. Regardless of the specific dimensions of the shank section 140, the shank sections of all of the string support members 70 are the same size to facilitate forming the base 80.

It is contemplated that it may be preferred to mount the string support member 70 directly in the material of the connection 46 between the neck and head portions 12 and 14. If this is done, the shank section would be dimensioned to provide the requisite support for the head section 142 of the string support member 70.

The head section 142 (FIGS. 5 and 6) of the string support member 70 includes a cylindrical base section 152 and a conical end section 154. The cylindrical base section 152 and conical end section 154 have central axes which are coincident with the central axis 116 (FIG. 6) of the string support member 70. Thus, the shank section 140, base section 152 and end sections 154 are disposed in a coaxial relationship.

The base section 152 has a cylindrical outer side surface 158 and a flat annular radially extending bottom surface 160. The annular bottom surface 160 extends between the upper end of the shank section 140 and the cylindrical outer side surface 158 of the base section 152 of the head section 142. The flat annular bottom surface 160 on the base section 152 extends parallel to and is coaxial with the flat circular bottom surface 150 on the shank section 140.

The conical end section 154 of the head section 152 is formed as a portion of a right circular cone having a central axis which is coincident with the central axis 116 of the string support member 70. The conical end section 154 has a conical outer side surface 164 with a flat circular end surface 166. The flat circular end surface 166 extends parallel to the bottom surface 150 of the shank section 140.

The conical outer side surface 164 has a slope, indicated at 168 in FIG. 6, which may be between 20° and 50°. The string support members 70 may all have the same construction. However, it may be preferred to have the specific angle 168 for the conical end section 154 depend upon the diameter of the string 32–40 which is to be engaged by the string support member 70. Thus, the angle 168 for a relatively small diameter string 30 (FIG. 4) may be relatively small and the angle 168 for a relatively large diameter string 40 may be relatively large. Thus, the string support members 70 in the string supports 50, 52, 54, 56, 58 and 60 (FIG. 4) may all have the same cone angle 168 (FIG. 6) or may have different cone angles depending upon the diameter of the string 30, 32, 34, 36, 38 and 40 to be supported by the string support.

Although it is contemplated that the head section 142 can be formed in many different sizes, in one specific embodiment of the string support member 70, the base section 152 of the head section 142 had a diameter of approximately 0.093 inches. This specific base section 152 had an axial extent or height of approximately 0.030 inches. In this specific embodiment of the string support member 70, the conical end section 154 had an axial extent or height of approximately 0.037 inches. It is contemplated that the string support member 70 will be constructed with a head section 142 having many different dimensions and angles. The foregoing specific dimensions and angles for the head section 152 have been set forth herein for purposes of clarity of description and not for purposes of limitation of the invention.

The string support member 72 (FIG. 3) in any one of the string supports 50–60 has the same construction as the string support member 70 in that particular string support. Since the string supports 50–60 (FIGS. 3 and 4) are associated with strings 30–40 of different diameters, the string supports 50–60 may have pairs of identical string supports 70 and 72 with dimensions which depend upon the diameter of the string which is engaged by a string support. It is also contemplated that the string support members 70 and 72 in the string supports 50–60 could be identical even through the strings 30–40 have different diameters.

In the illustrated embodiment of the string supports 50–60, the string support members 70 and 72 all have head sections 142 (FIG. 5) and base sections 152 having the same diameter and axial height. This results in the strings 30–40, which have different diameters, being supported with their uppermost portions different distances from the upper side surface 102 of the base 80. However, it is contemplated that the axial extent of the base section 152 of the various string support members 70 and 72 in the string supports 50–60 could be different so that the uppermost portions of each of the strings 30–40 is the same distance from the upper side surface 102 of the base member 80. This would result in a curving surface having the same center of curvature as the upper side surface 86 (FIG. 8) of the neck portion 12 of the instrument extending tangentially to the upper side of each of the strings 30–40. In such a string arrangement, the greater the diameter of the string 30, 32, 34, 36, 38 or 40 supported by a string support 50, 52, 54, 56, 58 or 60, the smaller would be the axial extent of the base section 152 of the string support members 70 and 72. Although it is contemplated that the cone angle 168 (FIG. 5) and/or axial extent of the base section 152 may be varied depending upon the diameter of the string 30–40 which a particular string support member 70 or 72 is to support, it is contemplated that the support members 70 and 72 in the string supports 50–60 could all have the same configuration if desired.

String Support Member Mounting

A plurality of pairs of identical cylindrical openings or apertures 180 and 182 (FIG. 4) are formed in a linear array in the base member 80 and receive the shank sections 140 of the string support members 70 and 72. Thus, for each pair of string support members 70 and 72 in the string supports 50–60, there is a pair of apertures 180 and 182. The apertures 180 and 182 are engaged by the shank sections 140 of the string support members 70 and 72 to position the string support members relative to the base member 80.

The apertures 180 and 182 have a cylindrical configuration and extend only part way through the base member 80. The forward or front half of each of the apertures 180 and 182 is formed in and extends through the front flange 106. The rearward or back half of each of the apertures 180 and 182 extends only part way through the body portion 110 of the base member 80 (FIGS. 7 and 8).

The central axis of each of the cylindrical apertures or openings 180 and 182 is disposed in the vertical plane 118 (FIG. 7) which contains the flat front side surface 90 of the groove 82 and the flat front side surface 96 of the base member 80. The parallel central axes of the cylindrical openings or apertures 180 and 182 are spaced apart by a distance which corresponds to the diameter of the cylindrical base section 152 (FIG. 5) of one of the string support members 70 or 72. Therefore, when the shank sections 140 of the string support members 70 and 72 are disposed in the apertures 180 and 182 (FIG. 3), the base sections 152 are disposed in abutting tangential engagement. The central axes of the base section 152 are coincident with the parallel central axes of the apertures 180 and 182.

Although the parallel central axes of the apertures 180 and 182 are spaced apart by a distance which is the same as the diameter of the base section 152 of one of the string support members 70 or 72, the apertures 180 and 182 have a diameter which is slightly less than the diameter of the shank sections 140 of the string support members 70 and 72. Therefore, there is an interference fit between the shank sections 140 of the string support members 70 and 72 and the apertures 180 and 182. When the shank sections 140 of the string support members 70 and 72 are disposed in the apertures 180 and 182, the flat annular bottom surfaces 160 on the head sections 142 are disposed in abutting engagement with the upper side surface 102 of the base member 80.

Since the apertures 180 and 182 are located with their central axes in the plane 118 (FIG. 6), the parallel central axes 116 of the support members 70 and 72 are positioned in the plane 118 when the base member 80 is positioned in the groove 82. When the base member 80 is deflected from the linear configuration of FIG. 3 to the arcuate configuration of FIG. 8, the central axes of the apertures 180 and 182 remain in the plane 118. Therefore, the central axes 116 of the string support members 70 and 72 remain in the plane 118. When the base member 80 has the curved configuration of FIG. 8, a line through the intersections of the central axes 116 of the string support members 70 and 72 with the end surfaces 166 on the head sections 142 will have a curved configuration corresponding to and having same center of curvature as the upper side surface 102 of the base member 80.

The string support members 70 and 72 are fixedly secured to the base member 80 so that they cannot move relative to the base member. The string support members 70 and 72 are connected with the base member 80 by an interference fit between the shank sections 140 of the string support members 70 and 72 and the apertures 180 and 182 in the base member 80. Of course, the string support members 70 and 72 could be connected with the base member 80 in a different manner if desired. For example, the shank sections 140 on the string support members 70 and 72 could be eliminated and the head sections 142 of the string support members could be connected to the upper side surface 102 of the base member 80. Alternatively, the string support members 70 and 72 could be mounted directly in openings or apertures formed in the material of the connection 46 between the neck and head portions 12 and 14 of the musical instrument 10.

Second Embodiment

In the embodiment of the invention illustrated in FIGS. 1–9, the base member 80 has a relatively thick main body section 110 which is received in the groove 82 (FIG. 7) and a pair of flanges 106 and 108 which overlap upper side surfaces 86 and 114 of the neck and head portions 12 and 14 at the connection 46 between the head and neck portions. In the embodiment of the invention of the invention illustrated in FIGS. 10–12, the base member is formed from a single piece of sheet metal which is bent to a desired configuration. Since the embodiment of the invention illustrated in FIGS. 10–12 is generally similar to the embodiment of the invention illustrated in FIGS. 1–9, similar numerals will be utilized to designate similar components, the suffix letter "a" being associated with the numerals of FIGS. 10–12 to avoid confusion.

A base member **80*a* (FIG. 10) is formed from a single piece of sheet metal (brass) and has a generally rectangular configuration. Thus, the base member 80*a* has a main body section 110*a* and a pair of downwardly (as viewed in FIG. 10) projecting locating or end sections 190 and 192. The end sections 190 and 192 are integrally formed as one piece with the main body section 110*a* and are connected with the main body section by ninety degree bends 194 and 196**.

The rectangular main body section **110*a* of the sheet metal base member 80*a* has a rectangular upper side surface 102*a*. As originally formed, the upper side surface 102*a* of the base member 80*a* is flat (FIG. 10). The base member 80*a* also has a lower side surface 104*a*. The rectangular lower side surface 104*a* of the base member 80*a* extends parallel to the upper side surface 102*a* of the base member. The base member 80*a* has front and rear flanges 106*a* and 108*a* (FIG. 12) which extend in opposite directions from the end sections 190 and 192. The flanges 106*a* and 108*a* have the same thickness as the remainder of the main body section 110*a*. A plurality of pairs of openings or apertures 180*a* and 182*a* (FIG. 10) are formed in a linear array in the base member 80*a***.

A plurality of pairs of support members **70*a* and 72*a* (FIG. 11) are fixedly secured to the base member 80*a* so that they cannot move relative to the base member. The string support members 70*a* and 72*a* are connected with the base member 80*a* by an interference fit between shank sections 140*a* of the string support members 70*a* and 72*a* and the apertures 180*a* and 182*a* in the base member 80*a*. The string support members 70*a* and 72*a* have the same construction as the string support members 70 and 72 of the embodiment of the invention illustrated in FIGS. 1–9**.

In the embodiment of the invention illustrated in FIGS. 10–12, the cylindrical base sections **152*a* of the head sections 142*a* of the string support members 70*a* and 72*a* (FIG. 11) are spaced a slight distance apart. Thus, a space 200 of approximately 0.0001 inches may be provided between the cylindrical base sections 152*a* of the string support members 70*a* and 72*a*. However, if desired, the string support members 70*a* and 72*a* could be positioned on the base member 80*a* with the base sections 152*a* of the head sections 142*a* in tangential abutting engagement, in the same manner as described in conjunction with the embodiment of the invention illustrated in FIGS. 1–9. Of course, the base section 152 of the string support members 70 and 72 of the embodiment of the invention illustrated in FIG. 1–9 could be spaced apart in the same manner as are the base sections 152*a* of the string support members 70*a* and 72*a* of the embodiment of the invention illustrated in FIG. 11**.

The musical instrument **10*a* with which the base member 80*a* is associated (FIG. 12) has a connection 46*a* between a neck portion 12*a* and a head portion 14*a*. A rectangular groove 82*a* is formed at the connection 46*a*. The groove 82*a* has a longitudinal central axis which extends perpendicular to a longitudinal central axis of the neck portion 12*a*. The neck portion 12*a* has an arcuate upper side surface 86*a*. In addition, the head portion 14*a* has an arcuate upper side surface 114*a* at a location adjacent to the connection 46*a***.

Due to the curving configuration of the upper side surface **86*a* of the neck portion 12*a* and the upper side surface 114*a* of the head portion 14*a*, the groove 82*a* is relatively deep at a central portion of the groove and relatively shallow adjacent to opposite ends of the groove. The groove 82*a* has a flat upwardly facing bottom surface 88*a* (FIG. 12) which extends beneath the strings of the musical instrument. In addition, the groove 82*a* has a flat front side surface 90*a*. A flat rear side surface 92*a* of the groove 82*a* extends parallel to the front side surface 90*a* and perpendicular to the bottom surface 88*a*. The groove 82*a* has a longitudinal central axis which extends parallel to the frets, corresponding to the frets 64 of FIG. 2, and perpendicular to the longitudinal central axis of the neck portion 12*a***.

The base member **80*a* is positioned relative to the groove 82*a* by engagement of a flat front side surface 204 (FIG. 10) on the end section 190 of the base member 80*a* with the flat front side surface 90*a* (FIG. 12) of the groove 82*a*. The base member 80*a* is also positioned relative to the groove 82*a* by engagement of a flat front side surface 206 (FIG. 10) on the end section 192 with the flat front side surface 90***a* (FIG. 12) of the groove 82*a*. The flat front side surfaces 204 and 206 (FIG. 10) on the end sections 190 and 192 are located relative to the apertures 180*a* and 182*a* in the main body section 110*a* of the base member 80*a* so that parallel central axes of the apertures 180*a* and 182*a* are disposed in a plane 118*a* (FIG. 12) containing the front side surface 90*a* of the groove 82*a*. This results in parallel central axes of the string support members 70*a* and 72*a* (FIG. 11) being disposed in the plane 118*a* when the base member 80*a* is positioned relative to the groove 82*a*.

When the base member 80*a* has been properly positioned relative to the groove 82*a* (FIG. 12), the front flange 106*a* overlaps the upper side surface 86*a* of the neck portion 12*a* and the rear flange 108*a* overlaps the upper side surface 114*a* of the head portion 14*a*. Screws 122*a* extend through openings 124*a* (FIG. 10) in the base member 80*a*. The screws 182*a* engage the wooden material of the instrument at the junction 46*a* between the head portion 14*a* and neck portion 12*a* of the instrument. In this embodiment of the invention, positioning elements, corresponding to the positioning elements 126 of FIGS. 4 and 9, have been eliminated.

Tightening of the screws 122*a* deflects the base member 80*a* to have a configuration which corresponds to the configuration of the upper side surface 86*a* of the neck portion 12*a* of the musical instrument. Once the screws 122*a* have been tightened, the main body section 110*a* of the base member 80*a* is resiliently deflected from the linear configuration of FIG. 10 to an arcuate configuration in which a longitudinal central axis of the base member 80*a* has the same arc of curvature as the upper side surface 86*a* of the neck portion 12*a* of the musical instrument. The end sections 190 and 192 of the base member 80*a* block opposite ends of the groove 82*a*.

Third Embodiment

In the embodiment of the invention illustrated in FIGS. 1–9 and 10–12, the string support members 70, 72, 70*a* and 72*a* all have the same general configuration. Thus, the string support members 70*a* and 72*a* (FIG. 11) have conical end sections 154*a* with the same configuration as the conical end sections 154 of the string support members 70 (FIG. 6). However, it is contemplated that the string support members 70, 72, 70*a* and 72*a* could be formed with arcuate outer side surfaces which engage a string and have a configuration other than a conical configuration. In the embodiment of the invention illustrated in FIG. 13, the string support member has an arcuate outer side surface with a configuration which is not conical. Since the embodiment of the invention illustrated in FIG. 13 is generally similar to the embodiment of the invention illustrated in FIGS. 1–9, similar numerals will be utilized to designate similar components, the suffix letter "b" being associated with the embodiment of the invention illustrated in FIG. 13 to avoid confusion.

The string support member 70*b* of FIG. 13 has a shank section 140*b* and a head end section 142*b*. The shank section 140*b* has a cylindrical side surface 148*b* and a flat circular bottom surface 150*b*. The head section 142*b* includes a cylindrical base section 152*b* having a cylindrical outer side surface area 158*b* and a flat annular bottom surface 160*b*.

In accordance with a feature of the embodiment of the invention illustrated in FIG. 13, the head section 142*b* of the string support member 70*b* has a hemispherical end section 154*b*. The hemispherical end section 154*b* has a continuous outer side surface 212 which forms a hemisphere, that is one-half of a sphere. The hemispherical outer side surface 212 of the string support member 70*b* cooperates with a hemispherical outer side surface on a second string support member, corresponding to the string support member 72 of FIG. 3, to support a string.

Although it is preferred to form the outer side surface 212 of the end section 154*b* of the head section 142 with a hemispherical configuration, it is contemplated that the outer side surface 212 could be formed of a different configuration if desired. For example, the outer side surface 112 could have an oval configuration and project upwardly away from the base section 152*b* further than does the hemispherical outer side surface 212. It is also contemplated that the entire head section 142*b* of the string support member 70*b* could be formed as a sphere. The shank portion 140*b* would extend axially outward from this sphere and would be used to connect the sphere with a base member.

A plurality of string support members 70*b* (FIG. 13) may be mounted in the openings 180 and 182 (FIG. 4) in the base member 80 in place of the string support members 70 and 72. Similarly, a plurality of string support members 70*b* (FIG. 13) may be mounted in the openings 180*a* and 182*a* (FIGS. 10 and 11) in the base member 80*a* in place of the string support members 70*a* and 72*a*. The string support members 70*b* would be positioned with their central axes in the plane 118 or 118*a* (FIGS. 7 and 12) of a front side surface 90 or 90*a* of a groove 82 or 82*a*. The flat annular bottom surfaces 160*b* of the head section 142*b* of each of the string support members 70*b* would engage the upper side surface of either the base member 80 or the base member 80*a*.

Conclusion

In view of the foregoing description, it is apparent that the present invention provides a new and improved string support 44 which is used in a musical instrument 10 of the guitar type. This type of musical instrument commonly has a plurality of strings 30–40 which extend from tuning devices 16 on a head portion 14, along a neck portion 12, to a body portion 9 of the instrument. The improved string support 44 positions the strings 30–40 relative to the head and neck portions 12 and 14 of the instrument.

The string support 44 may include a base member 80 which extends beneath the strings 30–40. A plurality of pairs of string support members 70 and 72 are disposed on the base member 80. Each of the string support members 70 and 72 has a shank section which is disposed in an opening 180 or 182 in the base member 80. Each of the string support members 70 or 72 includes head section 142 having an arcuate surface 164 which engages one of the strings 30–40 of the musical instrument 10. In one specific embodiment of the invention, the head section 142 of each of the string supports 70 and 72 includes a conical section 154 on which the arcuate surface 164, which engages one of the strings 30–40, is disposed. In another embodiment of the invention, the head section 142*b* of each of the string supports has a hemispherical section 154*b*.

Having described the invention, the following is claimed:

1. A stringed musical instrument, said stringed musical instrument comprising a body portion, a neck portion connected with and extending outward from said body portion, a head portion connected with said neck portion, a plurality of tuning devices mounted on said head portion, a plurality of strings each of which extends from one of said tuning devices along said neck portion to said body portion of said instrument, a base member connected with said musical instrument adjacent to a connection between said head and neck portions, said base member having plurality of pairs of openings, and a plurality of pairs of string support members connected with said base member, a first one of said pairs of string support members including first and second string support members which cooperate to support a first one of said strings of said plurality of strings, said first string support member in said first one of said pairs of string support members including a first shank section which is disposed in a first one of the openings in a first one of the plurality of pairs of openings in said base member and a first head section, said first head section having an arcuate outer side surface which engages said first one of said strings of said plurality of strings, said second string support member in said first one of said pairs of string support members including a second shank section which is disposed in a second one of the openings of said first one of the plurality of pairs of openings in said base member and a second head section, said second head section having an arcuate outer side surface which engages said first one of said strings of said plurality of strings.

2. A stringed musical instrument as set forth in claim 1 wherein said first shank section has a cylindrical outer side surface which extends into said first one of the openings in said first one of the plurality of pairs of openings in said base member, said first head section being disposed in engagement with said base member and extending radially outward of said first shank section, said second shank section having a cylindrical outer side surface which extends into said second one of the openings in said first one of the plurality of pairs of openings in said base member, said second head section being disposed in engagement with said base member and extending radially outward of said second shank section.

3. A stringed musical instrument as set forth in claim 1 wherein said arcuate outer side surface of said first head section has a center of curvature disposed on a central axis of said first string support member, said arcuate outer side surface of said second head section has a center of curvature disposed on a central axis of said second string support member.

4. A stringed musical instrument as set forth in claim 1 wherein said outer side surface of said first head section of said first string support member has a conical configuration, said outer side surface of said second head section of said second string support member having a conical configuration.

5. A stringed musical instrument as set forth in claim 1 wherein said base member has an outer side surface which faces toward said plurality of strings, said first head section being disposed in engagement with said outer side surface of said base member, said second head section being disposed in engagement with said outer side surface of said base member.

6. A stringed musical instrument as set forth in claim 1 further including a groove formed in said musical instrument adjacent to a connection between said head portion and said neck portion, said groove having a side surface area disposed in a plane which extends transversely to longitudinal axes of said strings, said base member being at least partially disposed in said groove, a central axis of said first string support member being disposed in the plane containing the side surface of said groove, a central axis of said second string support member being disposed in the plane containing the side surface of said groove.

7. A stringed musical instrument as set forth in claim 6 wherein said base member includes a side surface area which is disposed in abutting engagement with the side surface area of said groove to locate said base member relative to said musical instrument.

8. A stringed musical instrument as set forth in claim 1 wherein said neck portion has an arcuately curved side surface which faces toward said plurality of strings, said base member having an arcuately curved outer side surface which faces toward said plurality of strings and has a configuration which corresponds to the arcuately curved configuration of said side surface of said neck portion, said first head section being disposed in engagement with said arcuately curved outer side surface of said base member, said second head section being disposed in engagement with said arcuately curved outer side surface of said base member.

9. A stringed musical instrument as set forth in claim 1 wherein said first head section includes a first cylindrical portion having a circular end surface which is disposed in engagement with said base member, said arcuate outer side surface on said first head section being connected with an end of said first cylindrical portion opposite from said circular end surface, said second head section including a second cylindrical portion having a circular end surface which is disposed in engagement with said base member, said arcuate outer side surface on said second head section being connected with an end of said second cylindrical portion opposite said circular end surface on said second cylindrical portion.

10. A stringed musical instrument as set forth in claim 9 wherein said arcuate outer side surface on said first head section has a conical configuration with a central axis which is coincident with a central axis of said first cylindrical portion, said arcuate outer side surface on said second head section having a conical configuration with a central axis which is coincident with a central axis of said second cylindrical portion.

11. A stringed musical instrument as set forth in claim 9 wherein said arcuate outer side surface on said first head section has a hemispherical configuration with a center of curvature which is disposed on a central axis of said first cylindrical portion, said arcuate outer side surface on said second head section having a hemispherical configuration with a center of curvature which is disposed on a central axis of said second cylindrical portion.

12. A stringed musical instrument as set forth in claim 9 wherein said first cylindrical portion of said first head section is disposed in abutting engagement with said second cylindrical portion of said second head section.

13. A stringed musical instrument as set forth in claim 9 wherein said first cylindrical portion of said first head section is disposed closely adjacent to and spaced from said cylindrical portion of said second head section.

14. A stringed musical instrument as set forth in claim 1 further including a groove formed in said musical instrument adjacent to a connection between said head portion and said neck portion, said groove having first and second side surfaces which extend transversely to longitudinal axes of said strings and a bottom surface which extends between said first and second side surfaces, said base member having a main section which spans said groove, a first side section which extends into said groove at a location adjacent to a first end of said main section of said base member, and a second side section which extends into said groove at a location adjacent to a second end of said main section of said base member, and connector means extending from said main section of said base member into said groove to interconnect said base member and said musical instrument adjacent to the connection between said head and neck portions of said musical instrument.

15. A stringed musical instrument as set forth in claim 14 wherein said first and second side sections engage said first side surface of said groove to position said base member relative to said neck portion of said musical instrument.

16. A stringed musical instrument as set forth in claim 14 wherein said main section of said base member has a first side surface area which engages a side surface of said neck portion of said musical instrument adjacent to said first side surface of said groove and a second side surface area which engages a side surface of said head portion of said musical instrument adjacent to said second side surface of said groove.

17. A stringed musical instrument as set forth in claim 14 wherein said base member is formed from a single piece of sheet metal, said first side section of said base member being connected with said main section of said base member by a first bend formed in the single piece of sheet metal, said second side section of said base member being connected with said main section of said base member by a second bend formed in the single piece of sheet metal.

18. A stringed musical instrument as set forth in claim 14 wherein a portion of said main section of said base member overlaps and has a side surface area which engages a side surface of said neck portion of said musical instrument adjacent to said first side surface of said groove, said plurality of pairs of openings being at least partially formed in said portion of said base member which over laps said side surface of said neck portion of said musical instrument.

19. A stringed musical instrument as set forth in claim 1 wherein said outer side surface of said first head section of said first string support member has a hemispherical configuration, said outer side surface of said second head section of said second string support member having a hemispherical configuration.

20. A stringed musical instrument as set forth in claim 1 wherein said outer side surface of said first head section of said first string support member forms at least a portion of an outer side surface of a first sphere, said first shank section having a first central axis which extends through a center of curvature of said first sphere, said outer side surface of said second head section of said second string support member forms at least a portion of an outer side surface of a second sphere, said second shank section having a second central axis which extends through a center of curvature of said second sphere.

21. A stringed musical instrument, said stringed musical instrument comprising a body portion, a neck portion connected with and extending outward from said body portion, a head portion connected with said neck portion, a plurality of tuning devices mounted on said head portion, a plurality of strings each of which extends from one of said tuning devices along said neck portion to said body portion of said instrument, and a plurality of pairs of string support members connected with said musical instrument adjacent to a connection between said head and neck portions, each of said plurality of pairs of string support members including first and second string support members, said first string support member in each of said plurality of pairs of string support members including a first cylindrical section and a first conical section which is connected with said first cylindrical section and engages said one of said strings, said second string support member in each of said plurality of pairs of string support members including a second cylindrical section and a second conical section which is connected with said second cylindrical section and engages said one of said strings.

22. A stringed musical instrument as set forth in claim 21 wherein said first conical section has a central axis which extends parallel to a central axis of said second conical section.

23. A stringed musical instrument as set forth in claim 22 wherein said first cylindrical section has a central axis which is coincident with the central axis of said first conical section, said second cylindrical section having a central axis which is coincident with the central axis of said second conical section.

24. A stringed musical instrument as set forth in claim 21 wherein said first cylindrical section has a cylindrical outer side surface, said second cylindrical section having a cylindrical side surface which is disposed in engagement with said cylindrical outer side surface of said first cylindrical section.

25. A stringed musical instrument as set forth in claim 21 wherein said first cylindrical section has a first cylindrical side surface, said second cylindrical section having a second cylindrical side surface which is spaced from said first cylindrical side surface by a distance which is less than the diameter of said one of said strings of said plurality of strings.

26. A stringed musical instrument as set forth in claim 21 further including a groove formed in said musical instrument adjacent to a connection between said head portion and said neck portion, said groove having a side surface area disposed in a plane which extends transversely to longitudinal axes of said strings, said first conical section of said first string support member in each of said pairs of string support members having a central axis which is disposed in the plane containing the side surface of the groove, said second conical section of said second string support member in each of said pairs of string support members having a central axis which is disposed in a plane containing the side surface of the groove.

27. A stringed musical instrument as set forth in claim 21 further including a base member connected with said musical instrument adjacent to a connection between said head and neck portions, a groove formed in said musical instrument adjacent to a connection between said head portion and said neck portion, said groove having first and second side surfaces which extend transversely to longitudinal axes of said strings, said base member having a first portion which engages a side surface of said neck portion of said musical instrument adjacent to said first side surface of said groove, said base member having a second portion which engages a side surface of said head portion of said musical instrument adjacent to said second side surface of said groove.

28. A stringed musical instrument, said stringed musical instrument comprising a body portion, a neck portion connected with and extending outward from said body portion, a head portion connected with said neck portion, a plurality of tuning devices mounted on said head portion, a plurality of strings each of which extends from one of said tuning devices along said neck portion to said body portion of said instrument, a groove formed in said musical instrument adjacent to connection between said head and neck portions, said groove having a front side surface disposed in a plane which extends through said strings, a base member connected with said musical instrument adjacent to a connection between said head and neck portions, said base member having a plurality of pairs of openings with central axes disposed in the same plane as the front side surface of said groove, and a plurality of pairs of string support members connected with said base member, each of said pairs of string support members including first and second string support members which cooperate to support one of said strings of said plurality of strings, each of said string support members extending into one of the openings in said base member and having a central axis which is disposed in the same plane as the front side surface of said groove.

29. A stringed musical instrument as set forth in claim 28 wherein said first string support member in each of said pairs of string support members includes a first shank section disposed in a first one of the openings in one of the plurality of pairs of openings in said base member and a first head section which is connected with and projects outward of said first shank section, said first shank section and said first head section having a common central axis which is disposed in the same plane as the front side surface of said groove, said second string support member in each of said pairs of string support members including a second shank section disposed in a second one of the openings of said one of the plurality of pairs of openings in said base member and a second head section which is connected with an projects outward of said second shank section, said second shank section and said second head section having a common central axis which is disposed in the same plane as the front side surface of said groove, said first and second head sections in each of said pairs of string support members both being disposed in engagement with the same one of said strings of said plurality of strings.

30. A stringed musical instrument as set forth in claim 28 wherein said first string support member in each of said plurality of pairs of string support members includes a first shank section having a cylindrical configuration and disposed in a first one of the openings in one of the plurality of openings in said base member and a first conical section which is connected with said first shank section and engages one of said strings, said second string support member in each of said plurality of pairs of string support members includes a second shank section having a cylindrical configuration and disposed in a second one of the openings in one of the plurality of openings in said base member and a second conical section which is connected with said second shank section and engages said one of said strings.

31. A stringed musical instrument as set forth in claim 28 wherein said first string support member in each of said plurality of pairs of strings support members includes a first shank section having a cylindrical configuration and disposed in a first one of the openings in said base member and a first head section which is connected with said first shank section and has an outer side surface which forms at least a portion of a sphere and is in engagement with one of said strings, said second string support member in each of said plurality of pairs of string support members includes a second shank section having a cylindrical configuration and disposed in a second one of the openings in said base member and a second head section which is connected with said second shank section and has an outer side surface which forms at least a portion of a sphere and is in engagement with said one of said strings.

32. A stringed musical instrument as set forth in claim 28 wherein said base member is formed from a single piece of sheet metal.

33. A stringed musical instrument as set forth in claim 28 wherein said base member includes a main section which spans said groove, a first side section which is disposed at a first end of said main section and extends into said groove at a location adjacent to the first end of said main section of said base member, and a second side section which is disposed at a second end of said main section and which extends into said groove at a location adjacent to the second end of said main section.

34. A stringed musical instrument as set forth in claim 33 wherein said first and second side sections of said base member engage said front side surface of said groove to position said base member relative to said neck portion of said musical instrument.

35. A stringed musical instrument as set forth in claim 34 wherein said base member is formed from a single piece of sheet metal, said first side section of said base member being connected with said main section of said base member by a first bend formed in the single piece of sheet metal, said second side section of said base member being connected with said main section of said base member by a second bend formed in the single piece of sheet metal.

36. A stringed musical instrument, said stringed musical instrument comprising a body portion, a neck portion connected with and extending outward from said body portion, a head portion connected with said neck portion, a plurality of tuning devices mounted on said head portion, a plurality of strings each of which extends from one of said tuning devices along said neck portion to said body portion of said instrument, a base member connected with said musical instrument adjacent to a connection between said head and neck portions, said base member having first and second spaced apart openings, a first string support member having a first shank section which is disposed in said first opening in said base member and a first head section, said first head section being disposed outside of said first opening in said base member and having an arcuate outer side surface which engages one of said strings of said plurality of strings, said second string support member having a second shank section which is disposed in said second opening in said base member and a second head section, said second head section being disposed outside of said second opening in said base member and having an arcuate outer side surface which engages said one string of said plurality of strings.

37. A stringed musical instrument as set forth in claim 36 wherein said first shank section has a cylindrical outer side surface which extends into said first opening in said base member, said first head section being disposed in engagement with said base member and extending radially outward of said first shank section, said second shank section having a cylindrical outer side surface which extends into said second opening in said base member, said second head section being disposed in engagement with said base member and extending radially outward of said second shank section.

38. A stringed musical instrument as set forth in claim 36 wherein said arcuate outer side surface of said first head section has a center of curvature disposed on a central axis of said first string support member, said arcuate outer side surface of said second head section has a center of curvature disposed on a central axis of said second string support member.

39. A stringed musical instrument as set forth in claim 36 wherein said arcuate outer side surface of said first head section has a conical configuration, said arcuate outer side surface of said second head section having a conical configuration.

40. A stringed musical instrument as set forth in claim 36 wherein said base member has an outer side surface which faces toward said plurality of strings, said first head section being disposed in engagement with said outer side surface of said base member, said second head section being disposed in engagement with said outer side surface of said base member.

41. A stringed musical instrument as set forth in claim 36 further including a groove formed in said musical instrument adjacent to a connection between said head portion and said neck portion, said groove having a side surface area disposed in a plane which extends transversely to longitudinal axes of said strings, said base member being at least partially disposed in said groove, a central axis of said first string support member being disposed in the plane containing the side surface of said groove, a central axis of each of said second string support member being disposed in the plane containing the side surface of said groove.

42. A stringed musical instrument as set forth in claim 41 wherein said base member includes a side surface area which is disposed in abutting engagement with the side surface area of said groove to locate said base member relative to said musical instrument.

43. A stringed musical instrument as set forth in claim 36 wherein said neck portion has a side surface which faces toward said plurality of strings, said base member having an outer side surface which faces toward said plurality of strings, said first head section being disposed in engagement with said outer side surface of said base member, said second head section being disposed in engagement with said outer side surface of said base member.

44. A stringed musical instrument as set forth in claim 36 wherein said first head section includes a first cylindrical portion having a first circular end surface which is disposed in engagement with said base member, said arcuate outer side surface on said first head section being connected with an end of said first cylindrical portion opposite from said first circular end surface, said second head section including a second cylindrical portion having a second circular end surface which is disposed in engagement with said base member, said arcuate outer side surface on said second head section being connected with an end of said second cylindrical portion opposite said second circular end surface.

45. A stringed musical instrument as set forth in claim 36 further including a groove formed in said musical instrument adjacent to a connection between said head portion and said neck portion, said base member having a main section which spans said groove, a first side section which extends into said groove at a location adjacent to a first end of said main section of said base member, and a second side section which extends into said groove at a location adjacent to a second end of said main section of said base member.

46. A stringed musical instrument as set forth in claim 45 wherein said first and second side sections engage said groove to position said base member relative to said neck portion of said musical instrument.

47. A stringed musical instrument as set forth in claim 45 wherein said base member is formed from a single piece of sheet metal, said first side section of said base member being connected with said main section of said base member by a first bend formed in the single piece of sheet metal, said second side section of said base member being connected with said main section of said base member by a second bend formed in the single piece of sheet metal.

48. A stringed musical instrument as set forth in claim 36 wherein said outer side surface of said first head section of said first string support member has a hemispherical configuration, said outer side surface of said second head section of said second string support member having a hemispherical configuration.

49. A stringed musical instrument as set forth in claim 36 wherein said outer side surface of said first head section of said first string support member forms at least a portion of an outer side surface of a first sphere, said first shank section having a first central axis which extends through a center of curvature of said first sphere, said outer side surface of said second head section of said second string support member forms at least a portion of an outer side surface of a second sphere, said second shank section having a second central axis which extends through a center of curvature of said second sphere.

50. A stringed musical instrument as set forth in claim 36 wherein said outer side surface of said first head section of said first string support member has a conical configuration, said outer side surface of said second head section of said second string support member having a conical configuration.

51. A stringed musical instrument as set forth in claim 36 wherein said outer side surface of said first head section of said first string support member forms at least a portion of an outer side surface of a first cone, said first shank section having a first central axis which is coincident with a central axis of said first cone, said outer side surface of said second head section of said second string support member forms at least a portion of an outer side surface of a second cone, said second shank section having a second central axis which is coincident with a central axis of said second cone.

52. A string support for use in a stringed musical instrument and across which a plurality of strings extend, said string support comprising a base extending beneath the plurality of strings, said base having an upper side surface facing toward the plurality of strings, a plurality of pairs of openings extending downward from the upper side surface of said base, and a plurality of string support members connected with said base, each of said string support members having a shank section disposed in one of said openings and a head section which is connected with said shank section and engages said upper side surface of said base, said head section of each of said string support members having an arcuate side surface which engages one of the strings.

53. A string support as set forth in claim 52 wherein said head section has a circular bottom surface which is disposed in engagement with said upper side surface of said base.

54. A string support as set forth in claim 52 wherein said arcuate side surface of said head section has a conical configuration.

55. A string support as set forth in claim 52 wherein said arcuate side surface of said head section has a hemispherical configuration.

56. A stringed musical instrument, said stringed musical instrument comprising a body portion, a neck portion connected with and extending outward from said body portion, a head portion connected with said neck portion, a plurality of tuning devices mounted on said head portion, a plurality of strings each of which extends from one of said tuning devices along said neck portion to said body portion of said instrument, a base member connected with said musical instrument adjacent to a connection between said head and neck portions, and a plurality of string support members connected with said base member, each of said string support members including a shank section which is disposed in an opening in said base member and a head section, said head section having a conical outer side surface which engages one of said strings of said plurality of strings.

57. A stringed musical instrument, said stringed musical instrument comprising a body portion, a neck portion connected with and extending outward from said body portion, a head portion connected with said neck portion, a plurality of tuning devices mounted on said head portion, a plurality of strings each of which extends from one of said tuning devices along said neck portion to said body portion of said instrument, a base member connected with said musical instrument adjacent to a connection between said head and neck portions, and a plurality of string support members connected with said base member, each of said string support members including a shank section which is disposed in an opening in said base member and a head section, said head section having a hemispherical outer side surface which engages one of said strings.

* * * * *